US005245929A

United States Patent [19]

Wertz et al.

[11] Patent Number: 5,245,929

[45] Date of Patent: Sep. 21, 1993

[54] SEQUENCING TURNTABLE APPARATUS AND METHOD FOR PHYSICAL DISTRIBUTION, TRANSPORTATION AND WAREHOUSING

[76] Inventors: Frederick Wertz, 265 W. Mountain Rd., Sparta, N.J. 07871; Eugene Palffy, 17 Liberty St., Walden, N.Y. 12586

[21] Appl. No.: 900,657

[22] Filed: Jun. 19, 1992

[51] Int. Cl.[5] ..... B61J 1/00

[52] U.S. Cl. ..... 104/35; 104/29; 104/99

[58] Field of Search ..... 104/26.1, 27, 29, 30, 104/31, 35, 36, 37, 38, 39, 40, 41, 42, 43, 44, 45, 46, 47, 99

[56] References Cited

U.S. PATENT DOCUMENTS

| | | | |
|---|---|---|---|
| 1,452,426 | 4/1923 | Irwin | 104/44 |
| 1,454,348 | 5/1923 | Swinnerton | 104/44 |

FOREIGN PATENT DOCUMENTS

| | | | |
|---|---|---|---|
| 1434885 | 5/1969 | Fed. Rep. of Germany | 104/35 |
| 0455438 | 3/1950 | Italy | 104/35 |
| 0164754 | 1/1934 | Switzerland | 104/35 |
| 0725926 | 4/1980 | U.S.S.R. | 104/35 |

*Primary Examiner*—Mark T. Le
*Attorney, Agent, or Firm*—Paul R. Gauer

[57] ABSTRACT

A turntable for moving railcars is adapted to be concentrically positioned among a plurality of radially aligned, outer railways. The turntable has an azimuthally rotatable, annular frame having a spaced plurality of radially disposed, intermediate railways that selectively align with different ones of the outer railways. Also included is a platform having at least one central railway that can be aligned with at least one of the intermediate railways. This platform is mounted concentrically within the annular frame.

11 Claims, 3 Drawing Sheets

SEQUENCING TURNTABLE APPARATUS AND METHOD FOR PHYSICAL DISTRIBUTION, TRANSPORTATION AND WAREHOUSING

BACKGROUND OF THE INVENTION

The present invention relates to turntables for moving railcars, and in particular, to a turntable having a plurality of radially disposed railways.

Railway trains are often composed of a number of railcars having different destinations. Ideally railcars with the same destination will be placed consecutively, so they can be easily parsed as a group. Because railcars having the same destination may themselves come from different sources, it is difficult to place these railcars in sequence. Often a train is dispatched with the desired railcars out of sequence and then much effort must be spent decoupling randomly distributed railcars and directing them to a spur or other railways servicing a destination.

In railroad depots and repair shops, a turntable is often used to quickly direct a railcar or other vehicle to sheds or hangers that can be arranged around the turntable in a circle. These arrangements are used to save space and to quickly move railcars. See for example the comments in U.S. Pat. No. 3,534,688 at column 1, lines 5–9.

Known turntables (e.g., U.S. Pat. No. 889,372) have a turntable with a single track that can rotate to one of several radially disposed tracks. A disadvantage with such a turntable are the limitations associated with employing only a single track on a single table. When a railcar is placed on such a turntable, the table must be rotated and the railcar on the table must be removed before the table can be repositioned to accept a new railcar. See also U.S. Pat. Nos. 1,458,229; 1,590,534; 1,703,978; 2,049,813; 3,905,301; 4,041,873; and 4,429,636.

Accordingly, there is a need for an improved system for physical distribution, transportation and warehousing employing a turntable and other means for efficiently handling railway railcars.

SUMMARY OF THE INVENTION

In accordance with the illustrative embodiments demonstrating features and advantages of the present invention, there is provided a turntable for moving railcars. The turntable is adapted to be concentrically positioned among a plurality of radially aligned, outer railways. The turntable has an azimuthally rotatable, annular frame having a spaced plurality of radially disposed, intermediate railways segregated into aligned pairs that can selectively align with different ones of the outer railways. Also included is a platform having at least one central railway that can align with at least one of the intermediate railways. This platform is connected with means for rotatably mounting concentrically within the annular frame.

A related method of the same invention can move railcars between a plurality of radially disposed, outer railways, by employing a concentric assembly of radial, intermediate railways, and a concentric central railway. The method includes the step of aligning the central railway with a selected one of the intermediate railways and a selected one of the outer railways. Another step is rolling a first one of the railcars from the selected one of the outer railways to the selected one of the intermediate railways. Another step is turning the concentric assembly to align the selected one of the intermediate railways with a second one of the outer railways. Thus, the first railcar can be moved to that second one of the outer railways.

By employing such methods and apparatus an improved system is achieved for physically distributing, transporting and warehousing material. In a preferred embodiment, a dual turntable is composed of two concentric assemblies. The center assembly has, preferably, a crossed pair of tracks. The encircling outer assembly has, preferably, an equiangularly spaced, even number of railway tracks. At the periphery of the dual turntable are a plurality of radially aligned railways. The railways of the turntable can be placed in register with these outer railways.

In use, the turntable can bridge a gap in a feeder track when the center and the outer encircling assemblies are in alignment. Under these circumstances, one or possibly more railcars can be placed onto the outer encircling assembly, which then rotates out of alignment with the feeder track (possibly into alignment with a service spur). Once railcars are moved away from alignment with the feeder track, then other tracks on the outer encircling assembly can be realigned with the feeder track to receive other railcars. In this fashion, railcars to be distributed can be quickly placed on the encircling assembly and either stored thereon or rolled onto a service spur, while new railcars are being loaded onto the table from the feeder track.

While the center assembly was stationary in the above description, it can rotate with the encircling assembly when loaded with extremely long railcars ("supercars").

In a highly preferred embodiment the turntable can be placed inside the outer perimeter of a warehouse. The spurs from a turntable can be directed to corridors within the warehouse. These corridors can act as partitions to divide the floor space of the warehouse. Accordingly, a relatively compact warehouse can have within it a relatively high number of spurs that can be quickly filled with railcars from a train whose railcars are randomly ordered. The preferred turntable allows rapid distribution of randomly ordered railcars, which can be sent to any one of the spurs within the warehouse.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention, when taken in conjunction with the accompanying drawings wherein.

DETAILED DESCRIPTION OF THE PREFERRED EMBODIMENTS

Figure 1:
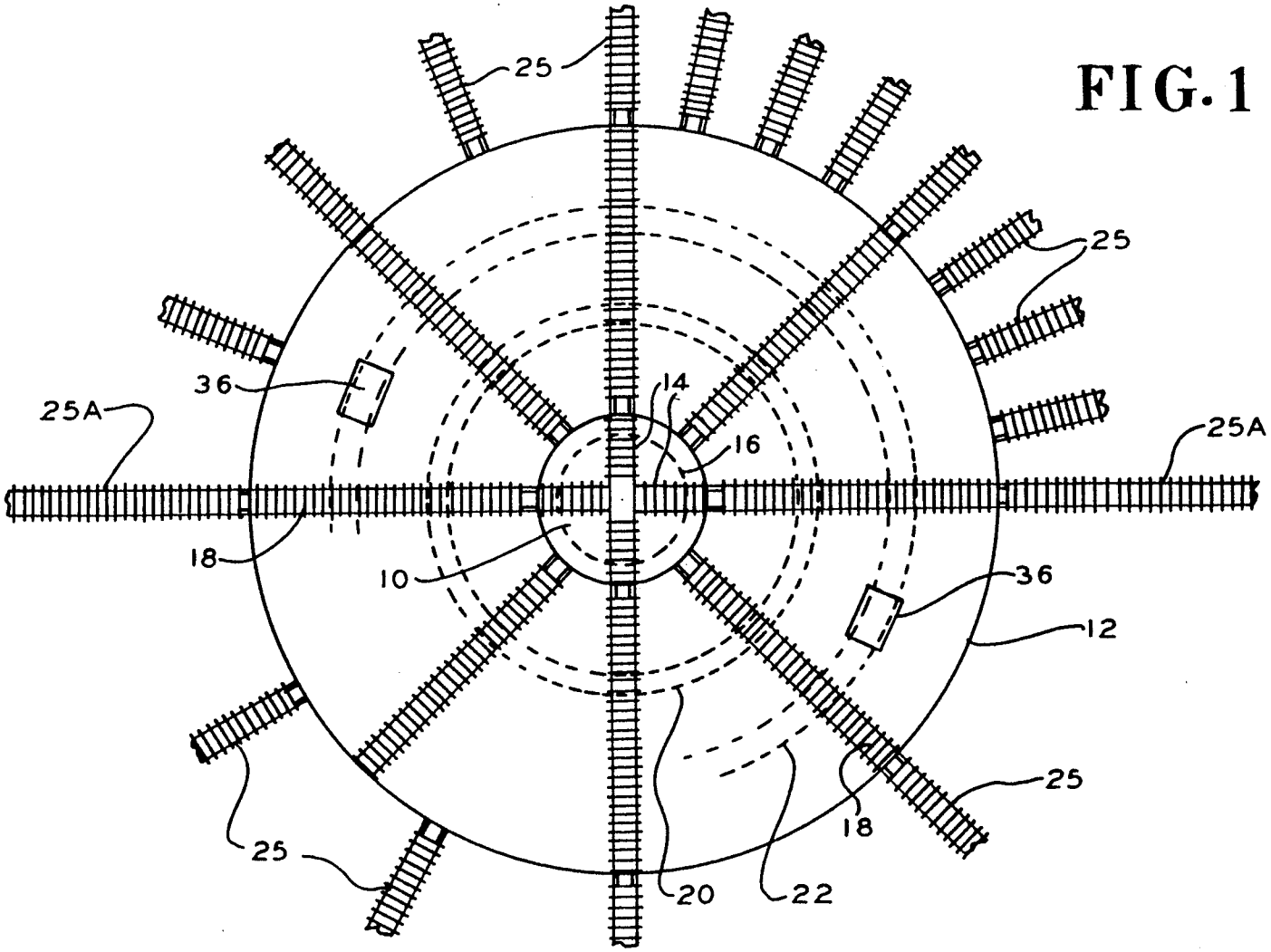
FIG. 1 is a plan view of a turntable in accordance with the principles of the present invention.

FIGS. 1–4 show a turntable. A central platform 10 is mounted concentrically and rotatably within a rotatable annular frame 12. Central platform 10 has a central railway in the form of a pair of perpendicularly crossing railway tracks 14. Platform 10 is rotatably mounted on circuitous railway 16 (see especially FIGS. 1 and 3). The diameter of central platform 10 is preferably 39 feet, although this dimension can be varied depending upon the expected size of the railcar and the desired capacity of the platform.

Annular frame 12 is shown supporting eight equiangularly spaced, intermediate railways 18 (shown as four aligned pairs of railways). This spacing allows each pair to operate with tracks 14 as a bypass. The intermediate railways 18 are preferably 60 feet long, but may have a different length, depending upon the capacity of the system and the expected size of the railcars.

A plurality of outer railways 25, 25A are illustrated in FIG. 1. Outer railways 25A, shown in this view in the 3 o'clock and 9 o'clock positions, are part of the feeder track used to bring railcars to and from the turntable. Outer railways 25 are also shown in the 6, 7, 8, and 12 o'clock positions. Inside the first quadrant (between the 3 and 12 o'clock positions) seven railways 25 are shown equiangularly spaced at 11.25° intervals. Inside the second quadrant (between the 9 and 12 o'clock positions) the three outer railways 25 are equiangularly spaced 22.5° intervals. A single outer railway 25 is centered equiangularly inside the fourth quadrant (between the 3 and 6 o'clock position).

In other embodiments the outer railways can be fewer or lesser in number and can be distributed at almost any convenient position. It is advantageous however, to have some of the outer railways 25 align with the intermediate railways 18, when two of them are aligned with the feeder railway 25A. Under these circumstances, railcars on railways 18 may be removed from the turntable, while new railcars are loaded onto the turntable from the feeder railway 25A. At the same time, the turntable can act a bypass for traffic on the feeder track 25A.

Figure 2:
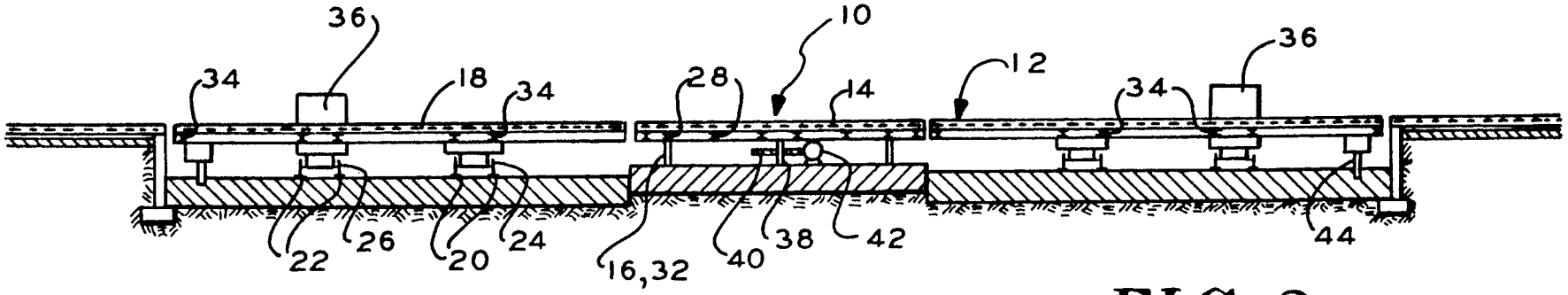
FIG. 2 is a cross sectional, elevational view of the turntable of FIG. 1.

Annular Frame 12 is rotatably supported on circuitous tracks 20 and 22. As shown in FIG. 2, a number of wheeled carriages 24 and 26 ride on circuitous tracks 20 and 22, respectively. Carriages 24 and 26 are trucks, much like those on railroad railcars, and may have a pair of axles, each axle having a pair of flanged wheels of the conventional type.

Figure 3:
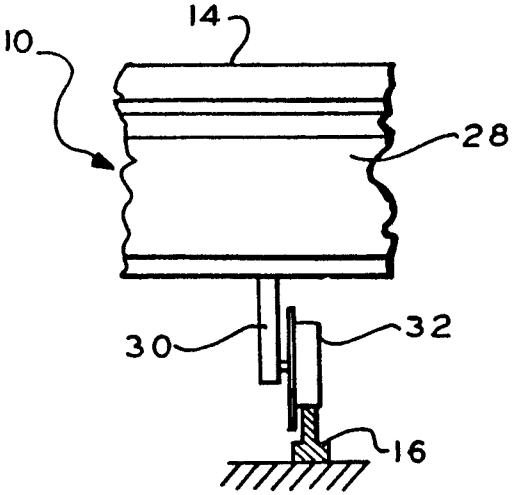
FIG. 3 is a detailed elevational view of a wheel support of FIG. 2.

Referring to FIG. 3, previously mentioned circuitous railway 16 is shown as a conventional rail bedded below platform 10. Platform 10 is shown including previously mentioned Railway 14 mounted atop I-beam 28. A strut 30 mounted below beam 28 rotatably supports a flanged wheel 32 shown riding on rail 16.

Platform 10 is composed of a frame of I-beams. I-beams 28 can be arranged in a grid or in a parallel group, much like floor joists. Alternatively, the I-beams can be arranged in concentric polygons. These I-beams 28 can be either welded together or can be joined by supporting struts or by an overlying or underlying panel. In some embodiments, the space between the railways 14 can be covered by a reticular structure such as subway grating or "Diamond" plate. The grating or plate need not necessarily be part of the supporting structure but in some embodiments will.

Similarly, I-beams 34 can provide the primary support structure for the annular frame 12. Again, the I-beams 34 can be arranged in a grid or in a group of concentric regular polygons. As before, struts or connecting plates or grates can provide the structural connection between the I-beams.

A pair of powered trucks 36 are shown mounted on diametrically opposite sides of frame 12, between intermediate railways 18. Trucks 36 drive along circuitous track 22. In this embodiment, powered trucks 36 can be much like the powered trucks found on diesel locomotives or subway railcars, that is, the wheels on the trucks can be turned by an electric motor. Alternatively, a diesel engine can be mounted on trucks 36 to directly power these trucks or to power a generator that drive the motors that move trucks 36.

In FIG. 2, platform 10 is shown connected to a drive shaft 38 which supports a drive gear 40. Motor means 42 can drive gear 40 to turn shaft 38 and platform 10. Motor means 42 can be an electric motor, a diesel motor, or other appropriate motor means.

Figure 4:
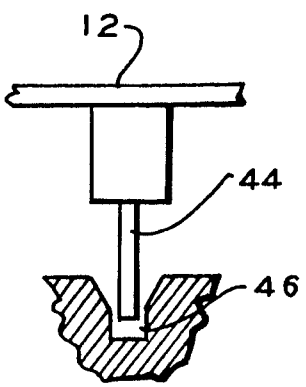
FIG. 4 is a detailed elevational view of a guide in FIG. 2.

FIGS. 2 and 4 show mounted on the periphery of frame 12, two or more guide members 44. Guide members 44 are positioned to ride inside a circuitous channel 46 and thereby laterally stabilize frame 12. In some embodiments, guide 44 can be a rod, a wheel or other structure.

The rotation of frame 12 and platform 10 can be done by manually actuating electrical switches that power or depower the drive source moving platform 10 and frame 12. Alternatively, platform 10 and frame 12 can have position sensing devices similar to those employed in elevators, so that frame 12 and platform 10 can rotate until they reaches a position marker indicating the need to decelerate and stop in registration with the appropriate track.

Figure 5:
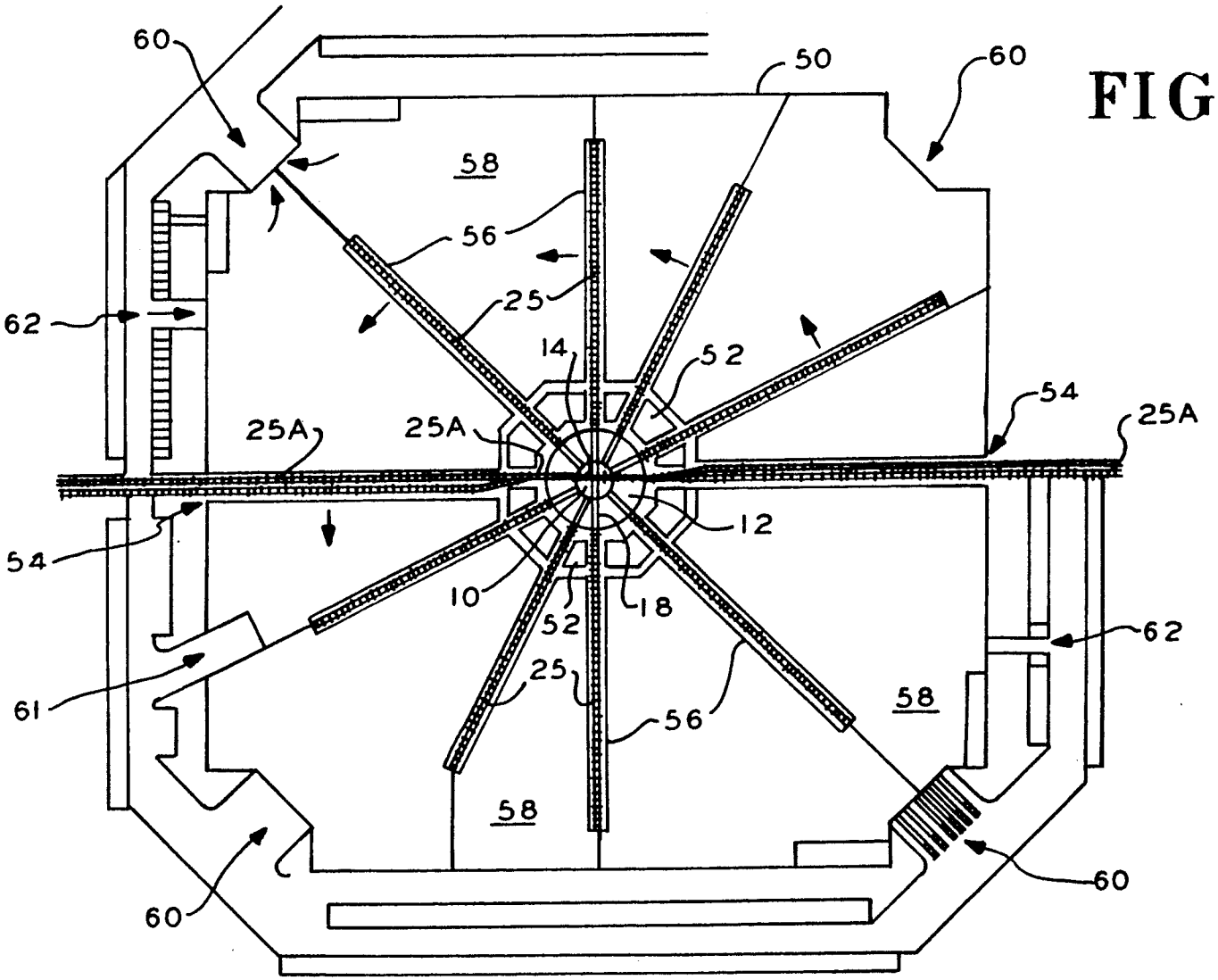
FIG. 5 is a plan view of a warehouse, including the turntable of FIGS. 1–4.

Referring to FIG. 5, the previously illustrated turntable is shown mounted in the center of a building 50, whose outer perimeter encompasses platform 10 and frame 12 of the turntable. Turntable 10, 12 is contained in a central chamber or atrium surrounded by utility rooms containing machinery for operating the turntable and for storing related equipment. A corridor 54 cuts through the center of building 50 and contains main feeder railway 25A. The entrances to corridor 54 can be closed if desired by an appropriate fence or gate (not shown). In some embodiments, corridor 54 is simply an alley between two building halves.

Building 50 is also shown with eight radial stub corridors 56 leading to turntable 10, 12. Corridors 56 contain previously mentioned outer railways 25. Corridors 56 may be hallways that are accessible not only by means of railways 25, but by means of loading doors (not shown) on one side of the corridor. For example, corridors are with an arrow indicating unloading direction. Thus some corridors is in this embodiment are accessible only from one side of the corridor. Corridors 56 act as partitions dividing building 50 into a ten chambers 58. Of course a different number of chambers can be created and in some embodiments the entire building will be one open structure utilized by a single owner.

Truck bays 60 shown at each of the four corners of building 50 provide access for loading and unloading material into the specific chamber 58 of the building. An additional truck bay 61 is shown along one side of the building. Also, chambers 58 have vehicle entrances 62 for allowing a van to enter the chambers for sheltered loading and unloading.

To facilitate an understanding of the principles associated with the foregoing equipment and building, its use will be briefly described. A train can be driven into building 50 along main feeder railway 25A (FIG. 5). When a railcar destined for building 50 reaches turntable 10, 12, the railcar is positioned on frame 12 either to the upstream or downstream side of annular frame 12. Once thus positioned, the railcar is decoupled at both ends and the adjacent railcars are moved away.

Next, powered trucks 36 (FIGS. 1 and 2) are started to turn frame 12 in either a clockwise or counterclockwise position. In some instances, two railcars can be placed on frame 12 on either side of platform 10. Frame 12 is rotated either to place the just removed railcar in alignment with a railway 25 destined to receive that railcar, otherwise the frame 12 is just incremented to the next position, so that the next available intermediate railway 18 aligns with feeder railway 25A.

If a previously removed railcar now aligns with its destination railway 25, two operations can occur simultaneously: The previously removed railcar can be shunted from frame 12 toward the end of its destination railway 25 inside building 25, while another railcar is positioned on frame 12. A railcar can be moved onto and along its destination railway 25 by well known portable rail railcar movers, although in some instances a small locomotive, a cable hauling line, or other apparatus may be used to move the railcars.

In the foregoing operation, the central platform 10 remained in position and did not rotate. Indeed in some embodiments platform 10 will be stationary by design. In some cases however, an extremely long railcar may exceed the width of annular frame 12 so that that railcar may actually need to straddle platform 10. In this case, the extra long railcar can still be handled, but the central platform 10 must turn together with frame 12. When platform 10 must rotate motor 42 (FIG. 2) is energized to drive gear 40 and shaft 38 to rotate plat-form 10. Thus once turntable 10, 12 is in alignment with the destination railway 25, the extra long railcar can simply travel over the still aligned railways on platform 10 and frame 12 to reach the destination railway 25.

By employing a separate central platform 10, a relatively large number of intermediate railways 18 can be achieved, eight in the disclosed embodiment. Without the central platform 10, eight separate tracks would converge at a single point, requiring an impractically complicated transition that would not reliably allow a railcar to cross the transition. With a large number of intermediate tracks 18, turntable 10, 12, can accommodate a large number of railcars. In fact, six railcars can be stacked onto frame 12, still leaving the turntable 10, 12 open to feeder railway 25A.

It is to be appreciated that various modification may be implemented with respect to the above described preferred embodiments. While the platform and frame are shown supported by rails and wheels, in some embodiments, the rails may be replaced with a flat road bed over which support wheels travel. Alternatively, a number of small support wheels mounted along the outer and inner perimeter of the frame or platform can ride in U-shaped channels to support the structure. On the other hand supporting roller can be mounted in the ground and the platform and frame roll over the rollers. While a powered truck is shown turning the frame, in other embodiments, the frame can be turned by a ring gear circumscribing the outer perimeter of the frame. Alternatively, a chain or cable system can engage a rack or groove encircling the frame. Also, the number and the angular orientation of the railways on and off the turntable can be varied, depending upon the desired size, capacity and strength of the system. Furthermore, in some embodiments the turntable will not be located inside of a building but centrally among a group of outbuildings or other facilities.

Obviously many modifications and variations of the present invention are possible in light of the above teachings. It is therefore to be understood that within the scope of the appended claims, the invention may be practiced otherwise then as specifically described.

We claim:

1. A turntable for moving railcars adapted to be concentrically positioned among a plurality of radially aligned, outer railways, comprising:

an azimuthally rotatable, annular frame having a spaced plurality of radially disposed, intermediate railways segregated into aligned pairs for selectively aligning with different ones of said outer railways; and a platform having at least one central railway for aligning with at least one of said intermediate railways, said platform being connected with means for rotatably mounting said platform concentrically within said annular frame.

2. A turntable according to claim 1 wherein said turntable is housed in a building which is partitioned and comprises a plurality of partitions each aligned with a corresponding one of said intermediate railways, so that said building is segregated into chambers each served by one or more of said outer railways.

3. A turntable according to claim 1 further comprising:

a circuitous track bedded below said annular frame; and a wheeled carriage mounted underneath said annular frame for riding said circuitous track.

4. A turntable according to claim 3 wherein said wheeled carriage comprises:

a plurality of auxiliary trucks supportively mounted underneath corresponding ones of said intermediate railways to ride said circuitous track.

5. A turntable according to claim 4 further comprising:

a powered truck for turning said annular frame.

6. A turntable according to claim 5 wherein said powered truck is mounted in said annular frame between an adjacent pair of said intermediate railways to drive on said circuitous track.

7. A turntable according to claim 6 further comprising:

a circuitous railway bedded below said platform; and a wheel journalled underneath said platform for riding said circuitous railway.

8. A turntable according to claim 7 further comprising:

motor means for applying a torque at the center of said platform for turning it.

9. A turntable according to claim 8 further comprising:

a circuitous channel bedded below said annular frame at its perimeter; and a guide member depending from said annular frame and projecting into said circuitous channel for guiding said annular frame.

10. A turntable according to claim 1 wherein said central railway of said platform comprises a pair of perpendicularly crossing railway tracks.

11. A method for moving railcars between a plurality of radially disposed, outer railways, by employing a concentric assembly of radial, intermediate railways, and a concentric central railway, comprising the steps of:

aligning said central railway with a selected one of said intermediate railways and a selected one of said outer railways;

rolling one or more of the railcars from said selected one of said outer railways to said selected one of said intermediate railways; and turning said concentric assembly to align said selected one of said intermediate railways with another one of said outer railways so that said one or more of said railcars can be moved to said another one of said outer railways; and turning said central railway with said concentric assembly to align said selected one of said intermediate railways and said central railway with another one of said outer railways.

* * * * *